United States Patent [19]

Schantz et al.

[11] Patent Number: 4,545,361

[45] Date of Patent: Oct. 8, 1985

[54] GAS HORSESHOE FORGE

[75] Inventors: Robert E. Schantz, 1226 Mead Dr., St. Louis, Mo. 63137; James D. McCune, Maryland Heights; Pleasant A. Prunty, Hillsboro, both of Mo.

[73] Assignee: Robert E. Schantz, St. Louis, Mo.

[21] Appl. No.: 596,259

[22] Filed: Apr. 3, 1984

[51] Int. Cl.[4] ..... F24C 1/00

[52] U.S. Cl. ..... 126/226; 431/354; 126/233; 126/237; 126/229

[58] Field of Search ..... 431/354, 343, 159; 126/233, 237, 229, 231, 227, 240, 236, 226, 239; 432/120, 224, 231, 250; 239/559, 424, 427; 48/180 C

[56] References Cited

U.S. PATENT DOCUMENTS

| | | | |
|---|---|---|---|
| 1,397,178 | 11/1921 | Needham | 126/237 |
| 1,421,158 | 6/1922 | Brooks | 431/354 |
| 1,700,269 | 1/1929 | Loepsinger | 431/354 X |
| 1,818,783 | 8/1931 | Beam | 431/354 X |
| 3,078,915 | 2/1963 | Webster | 431/354 |
| 3,501,098 | 3/1970 | Evans | 431/354 X |
| 3,752,643 | 8/1973 | Robinson | 431/120 |
| 3,759,245 | 9/1973 | Greco, Sr. | 431/354 |
| 3,814,576 | 6/1974 | Brockhurst | 431/354 |
| 3,960,093 | 6/1976 | Gregory | 110/3.5 |
| 4,424,025 | 1/1984 | Jones | 432/120 |

FOREIGN PATENT DOCUMENTS

| | | | |
|---|---|---|---|
| 509516 | 11/1920 | France | 126/263 |
| 9965 | of 1908 | United Kingdom | 126/233 |

*Primary Examiner*—Randall L. Green
*Attorney, Agent, or Firm*—Glenn K. Robbins

[57] ABSTRACT

A portable gas forge. The forge is comprised of a housing having an insulated interior and an opening for insertion of the article to be heated such as a horseshoe or the like. The forge is resistant to blow-out by wind when used in the field and has a specially designed burner connected to the top of the housing. The burner is connected to a source of gas such as an LP gas cylinder. A gas orifice is connected to an enlarged burner pipe having a bell-shaped primary air inlet adjacent the gas orifice. A source of secondary air is located at the exterior burner pipe connection to the housing to obtain maximum flame concentration in the housing and inhibit back flaming.

7 Claims, 5 Drawing Figures

GAS HORSESHOE FORGE

BACKGROUND OF THE INVENTION

In the past various types of portable gas forges have been employed in the field. One such important use has been that of the farrier or horseshoer for working and forming horseshoes. In the field use access to electrical or other source of power is limited and a simply operated gas forge is highly desirable for maximum efficiency at a low cost.

While such portable gas forges have been available, they have been subject to burn-out or flame-out where sudden gusts of wind extinguish the flame and require reignition with the consequent disavantage of downtime and interruption of the operation. When working with horses such interruption can be especially troublesome with horses of a nervous diposition. Such flame-out can be caused unexpectedly in gas forges in which the burner outlet is spaced from the housing burner opening to provide for combustion air introduction. Such burners, while efficient in the absence of wind currents are troublesome in the field and also require operation at substantial gas pressures which detracts from an economic operation.

SUMMARY OF THE INVENTION

By means of this invention there has been provided a portable gas forge which can be operated in the field in windy conditions efficiently and at relatively low gas pressure and low cost.

The forge is comprised of a housing having an insulated liner and a shelf for supporting articles to be heated such as horseshoes or the like. An opening in the housing provides access for insertion and removal of the horseshoes. While the forge is particularly described in connection with the working of horseshoes, it will be understood that other metallic articles may be employed which are to be heated and brought up to forge working temperatures of 1400°–1800° F. or as high as welding temperatures of the order of 2200° F.

A specially designed burner is employed which uses a standard gas supply such as a cylinder of LP gas. Through the use of this burner protection from effects of wind is obtained together with the advantage of operation at a low gas pressure of 5 to 10 pounds per square inch for a working forge temperature and 12 to 15 pounds per square inch for welding temperatures. This is to be contrasted with the considerably higher pressures of about 25 pounds per square inch for working temperatures and 40 pounds per square inch for welding temperature in prior forges employing a burner spaced from the housing.

The burner of this invention comprises a burner pipe or conduit which extends from a source of LP gas directly to the top of the forge housing to direct a high temperature flame into the housing to heat the horseshoe or other article. A restricted small diameter gas orifice opens into the center of the enlarged pipe and is surrounded by an enlarged primary air inlet.

The enlarged primary inlet is in the form of a bell-shaped air inlet into which the gas orifice is centered. Primary air is drawn into the burner pipe by a venturi suction to create a combustible gas mixture which is ignited to form the gas high temperature flame inside the forge.

Secondary air is introduced into the burner pipe adjacent a junction of the pipe with the housing. Circumferential ports provide for even introduction of secondary air into the combustible air-gas mixture to inhibit flaming or burning of the gas inside the burner pipe before it is introduced into the forge housing.

The portable forge of this invention is simply operated in the field to provide a wind and weather resistant gas forge which can be rapidly brought up to temperature. It is rugged in construction and may be employed at a high degree of efficiency and at relatively low cost.

The above features are objects of this invention. Further objects will appear in the detailed description which follows and will be further apparent to those skilled in the art.

For the purpose of illustration of this invention, preferred embodiments thereof are shown in the accompanying drawing. It is to be understood that the drawing is for purpose of description only and that the invention is not limited thereto.

IN THE DRAWING

DESCRIPTION OF THE INVENTION

Figure 1:
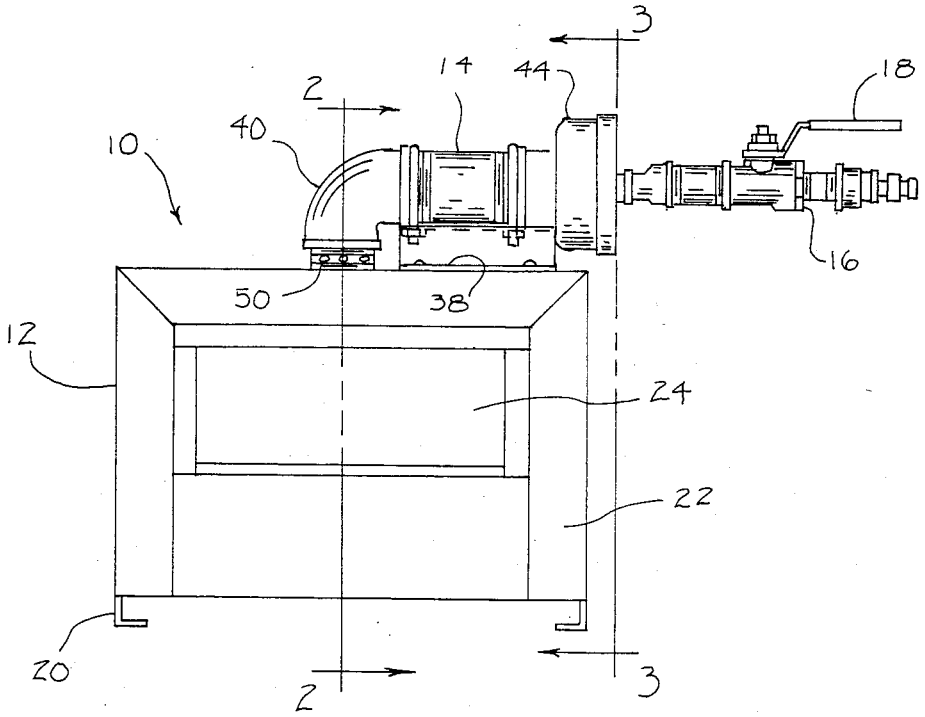
FIG. 1 is a view of the forge in front elevation.
Figure 2:
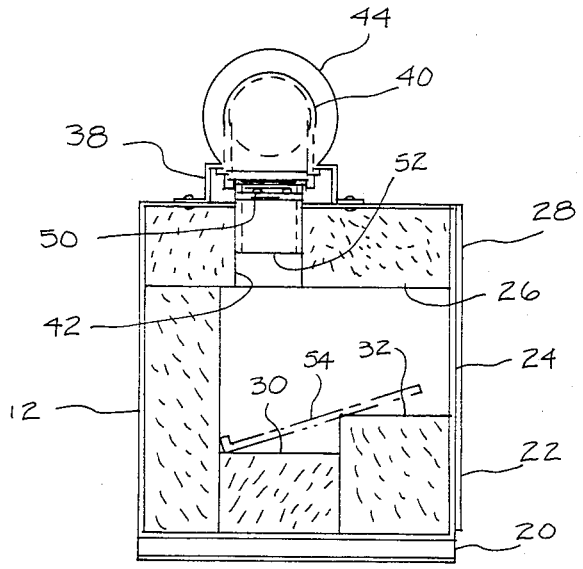
FIG. 2 is a view in section taken on the line 2—2 of FIG. 1.
Figure 3:
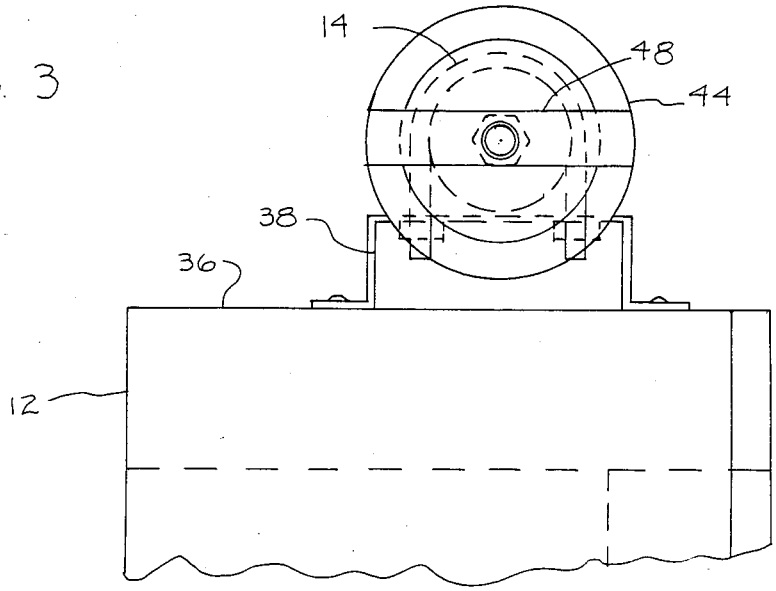
FIG. 3 is a view in section taken on line 3—3 of FIG. 1.
Figure 4:
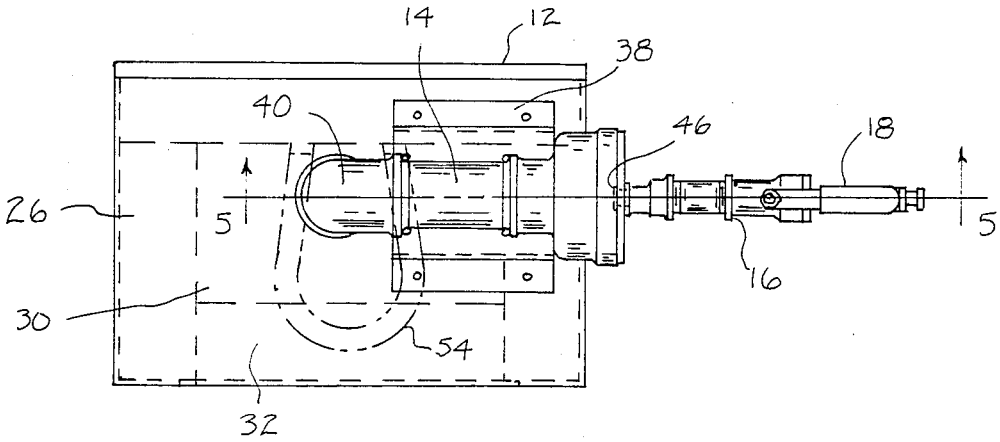
FIG. 4 is a top plan view.

The gas forge of this invention is generally indicated by the reference numeral 10 in FIGS. 1, 2 and 4. It is comprised of a housing 12, a burner 14 and a gas line 16 and valve 18. The gas line is connected to a conventional LP gas tank (not shown).

The housing is supported on legs 20 and has a front wall 22 provided with an opening 24. An insulated interior lining 26 is used for heat retention and insulation and is covered by an exterior protective shell 28 which may be of metal or the like. The interior of the housing has a bottom wall 30 bounded by a shelf or ledge 32. This configuration enables an article to be supported in a tilted position as shown in FIG. 2.

Figure 5:
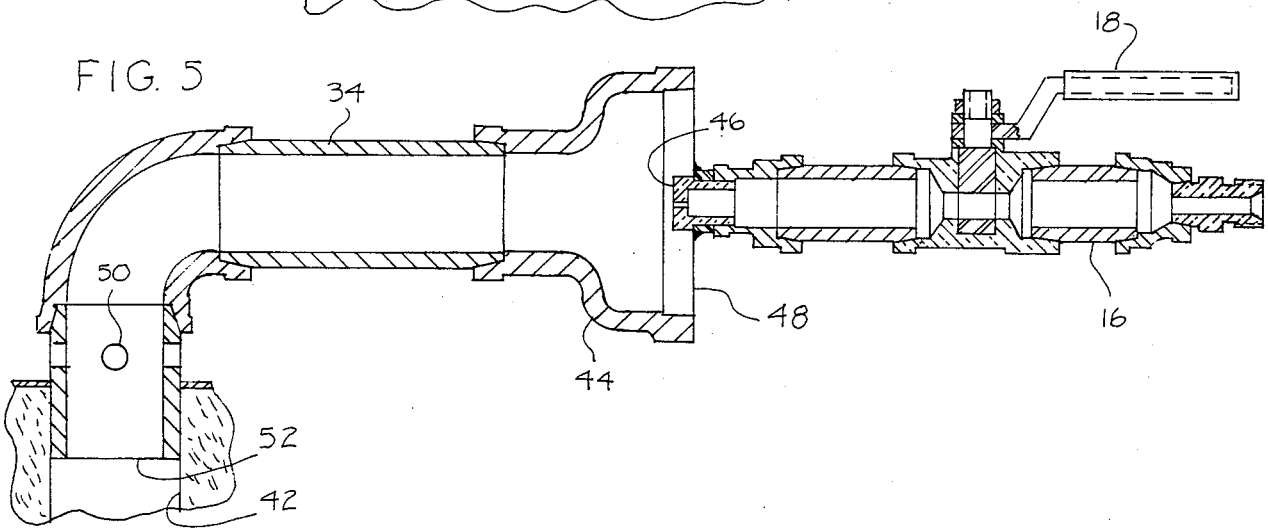
FIG. 5 is an enlarged view in section taken on line 5—5 of FIG. 4.

The burner construction is best shown in FIGS. 1 and 5. It is comprised of a main body 34 supported on a top wall 36 of the housing by a brace 38. The body has a forward elbow portion 40 extending into an opening 42 in the housing top wall to direct the burner flame into the interior of the housing.

A rear portion of the burner housing is provided with an enlarged bell-shaped primary air inlet 44. This air inlet has an internal diameter substantially greater than that of the main body of the burner to permit the intoduction of air by aspiration into the interior of the main body of the burner.

The bell-shaped primary air inlet further serves to support a small diameter gas orifice 46 within the center of the air inlet. The orifice is connected to the gas line and is supported by a cross brace member 48 upon the primary air inlet.

In order to provide secondary air to the air gas mixture in the main body 34 of the burner a plurality of secondary air inlets 50 are provided. These are in the form of equidistantly spaced circumferential openings in the burner elbow adjacent the top wall of the housing. The secondary air openings provide an additional source of air upstream from the burner outlet 52 inside the housing to prevent interior burning within the burner body.

OPERATION

The portable gas forge of this invention is very easily used in the field. It is transported with a small cylinder of LP gas and may be simply carried in a car or truck to the desired location.

For ignition, the valve 18 is opened and a lighted taper is inserted into the interior of the housing to ignite the burner. No bellows or forced air of any type is required.

The bell-shaped primary air inlet introduces air by aspiration created by the ejection of gas under pressure through the orifice 46. The combustible mixture so produced flows through the main body of the burner through the outlet 52 into the interior of the forge housing.

Secondary air is introduced through the secondary air opening 50. This air inhibits burn back or burning inside the main body of the burner to ensure that the flame is emitted from the burner to the interior of the housing.

After the burner flame has been established, the article to be heated such as the horseshoe 54 shown in FIGS. 2 and 4 is grasped by a pair of tongs and inserted through the forge opening 24 and rested against the ledge. When heated to the proper heat, it is removed for working.

The temperature within the forge is adjusted by the conventional pressure regulator on the gas cylinder (not shown) as in conventional practice. Generally working forge temperatures within the range of 1400°–1800° F. are obtained at 5 to 10 pounds per square inch gas pressure while higher welding or fusion temperatures of the order of 2200° F. are obtained at 12 to 15 pounds per square inch pressure. When the horseshoe has been brought up to the cherry red heat for working forging temperature or white hot heat for welding temperature it is removed and worked as required.

The forge of this invention may be moved in or out of line with the prevailing wind or weather as required. Ambient air is all that is necessary for the primary and secondary air and bellows or forced air is not employed. It may be employed in the field in adverse weather conditions in a simple and efficient manner and due to its rugged construction will withstand the considerable wear, tear and abuse accompanying such use in the field.

Various changes and modifications may be made within this invention as will be apparent to those skilled in the art. Such changes and modifications are within the scope and teaching of this invention as defined in the claims appended hereto.

What is claimed is:

1. In a portable gas forge for heating horseshoes and the like in the field, said forge being comprised of a boxlike housing having an insulated interior and an opening in a front wall for insertion of the horseshoe to be heated, the improvement comprising a wind-resistant low pressure burner outlet of a burner extending into and closely received in engaging relation within an opening in a top wall of the housing, said burner having a substantially imperforate main body extending from said burner outlet within said top wall rearwardly to a gas source supply, said burner outlet terminating in an opening in an insulated portion of said top wall to provide an unobstructed interior in the housing, said gas source supply being connected to a restricted orifice supported in an enlarged annular rear primary air opening at a rear portion of the burner main body and said burner having a secondary air opening communicating directly with ambient air exteriorly of said housing and closely adjacent thereto, said primary air opening having an area substantially larger than said secondary opening.

2. The gas forge of claim 1 in which said primary air opening comprises a bell-shaped member having an enlarged opening greater than the internal diameter of a tubular member comprising said main body.

3. The gas forge of claim 2 in which said restricted orifice is supported in protective relation within the center of the enlarged opening of said bell-shaped member.

4. The gas forge of claim 1 in which said secondary air opening is comprised of a plurality of relatively small openings.

5. The gas forge of claim 4 in which said relatively small openings are equi-distantly spaced around the periphery of the burner main body.

6. The gas forge of claim 2 in which said secondary air opening is comprised of a plurality of relatively small openings.

7. The gas forge of claim 3 in which said secondary air opening is comprised of a plurality of relatively small openings and said relatively small openings are equi-distantly spaced around the periphery of the burner main body.

* * * * *